US011136160B2

(12) United States Patent
Schoubben

(10) Patent No.: US 11,136,160 B2
(45) Date of Patent: Oct. 5, 2021

(54) NON-DRIP UPSIDE DOWN BOTTLES

(71) Applicant: The Procter & Gamble Company, Cincinnati, OH (US)

(72) Inventor: Jimmy Schoubben, Gentbrugge (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/748,048

(22) Filed: Jan. 21, 2020

(65) Prior Publication Data

US 2020/0239176 A1 Jul. 30, 2020

(30) Foreign Application Priority Data

Jan. 24, 2019 (EP) ..... 19153506
Oct. 16, 2019 (EP) ..... 19203544

(51) Int. Cl.
*B65D 1/02* (2006.01)
*B65D 51/24* (2006.01)
*B65D 47/20* (2006.01)
*B65D 1/32* (2006.01)

(52) U.S. Cl.
CPC ..... *B65D 1/0223* (2013.01); *B65D 1/0207* (2013.01); *B65D 47/2031* (2013.01); *B65D 51/249* (2013.01); *B65D 1/32* (2013.01); *B65D 2501/0081* (2013.01)

(58) Field of Classification Search
CPC B65D 1/0223; B65D 1/0207; B65D 47/2031; B65D 51/249; B65D 2501/0081; B65D 1/32
USPC ..... 222/212–215
See application file for complete search history.

(56) References Cited

U.S. PATENT DOCUMENTS 5,213,236 A * 5/1993 Brown ..... B65D 47/2031 222/212
6,436,497 B1 * 8/2002 Takahashi ..... B65D 1/0207 264/523
8,567,625 B2 * 10/2013 Nemoto ..... B65D 1/0223 215/384
10,518,923 B2 * 12/2019 Koenig ..... B65D 1/0207
10,611,531 B2 * 4/2020 Hoefte ..... B65D 1/32
10,669,060 B2 * 6/2020 Sekiguchi ..... B29C 73/166
10,737,822 B2 * 8/2020 Dygert ..... B65D 1/0207
2008/0029548 A1 * 2/2008 De Wree ..... B65D 47/2031 222/212
2012/0080450 A1 * 4/2012 Dziersk ..... B65D 47/2031 222/173
2016/0244222 A1 * 8/2016 Sterling ..... G01F 11/30
(Continued)

FOREIGN PATENT DOCUMENTS

CN 1507827 A 6/2004
CN 2784322 Y 5/2006
(Continued)

OTHER PUBLICATIONS

European Search Report for Application No./Patent No. 19153506.1-1017, dated Aug. 29, 2019, 7 pages.

*Primary Examiner* — Frederick C Nicolas
(74) *Attorney, Agent, or Firm* — Melissa Krasovec

(57) ABSTRACT

The need for a bottom dispensing package comprising a base having an orifice comprising a slit-valve, which is less prone to leakage, even when a lower viscosity product is comprised in the container, is met by providing the container with a more elastic resiliently squeezable container.

17 Claims, 6 Drawing Sheets

(56) References Cited

U.S. PATENT DOCUMENTS

| | | | | |
|---|---|---|---|---|
| 2019/0308780 | A1* | 10/2019 | Baumann | B65D 47/18 |
| 2021/0017475 | A1* | 1/2021 | Braeckman | C11D 3/2086 |

FOREIGN PATENT DOCUMENTS

| | | | |
|---|---|---|---|
| DE | 10122557 | A1 | 11/2001 |
| EP | 3492400 | A1 | 6/2019 |

* cited by examiner

NON-DRIP UPSIDE DOWN BOTTLES

TECHNICAL FIELD

The present invention relates to bottom-dispensing containers comprising a slit valve, wherein the container is less prone to leakage.

BACKGROUND OF THE INVENTION

Liquid consumer products are contained in a wide variety of containers. A growing number of food products and liquid personal care products are provided in inverted containers, since they provide less hold-up of product inside the container, and enable easy dispensing of more of the product. For instance, Heinz revolutionized the 170-year-old ketchup industry in 2002 when it introduced its inverted container with a cap comprising a discharge channel having a slit-valve. Previously, consumers had complained for years about how hard it was to squeeze out that last bit of ketchup. By solving such technical problems, companies are able to make their products less annoying for consumers, and happy consumers means more consumers buying the product. More consumers buying the product makes the people at the consumer products company happy as well. However, such slit-valve comprising inverted containers bring their own challenge, including messiness from unwanted product leakage during transport or as the container is left on the shelf. Such leakage can be due to pressure changes during transport (for instance, because of altitude changes) or during storage at home (for instance, from temperature changes when left in sunlight). As the container is emptied, such leakage becomes more problematic. This is because the liquid composition is replaced with air which has a greater coefficient of expansion upon temperature changes than the liquid, and since the slit-valve is less resistant to leakage due to dried residues building up on the valve.

Therefore, inverted container have typically been used for liquid products which are thixotropic or have a high low shear viscosity, such as ketchup and mayonnaise. Even for such products, leakage problems have typically meant that a secondary sealing cap is required in order to seal the discharge channel when the product is not in use (for instance, when the product is stored on a shelf).

Additionally, bottom dispensing packages which comprise an orifice having a slit valve often become more difficult to use as more of the product contained therein is dispensed. This is because insufficient air is drawn back into the container after squeezing, especially as more product is dispensed, resulting in the container remaining in its deformed state. One way of alleviating such permanent deformation is by using a slit-valve which is activated at lower pressure differentials. However, such packages have been found to be particularly unsuited for use with lower viscosity liquids, due to leakage between use.

For the above reasons and more, the use of upside-down containers comprising a slit-valve for detergent compositions has typically been limited to high-viscosity gels, such as shower-gels and the like. For lower viscosity products, a screw-on, twist-off, or similar closure means has been required to fully seal the discharge point and avoid leakage. Even when such full closure means are used in combination with a slit-valve, messy residues can still accumulate between the slit-valve and closure means. Such residues can even block the slit-valve upon drying.

Moreover, the addition of such a full-closure means results in the consumer having to use both hands in order to dispense the product. This makes the use of the product much less convenient to the consumer, especially for such applications as food dispensing and dishwashing. Such residues and additional inconvenience makes the consumer less happy, and less happy consumers buy less products, which makes the people who work at consumer products companies less happy too.

As such, a need remains for an inverted container comprising a slit-valve at the discharge point, which is less prone to leakage with changes in ambient temperature, even when a lower viscosity product is comprised in the container.

U.S. Pat. No. 5,213,236 relates to a dispensing package for fluid products such as liquid soaps, shampoos and conditioners, house hold detergents, cleaners, polishes, moisturizing creams, and the like, and includes a container with a self-sealing dispensing valve mounted therein. The valve includes a marginal flange, a valve head with a discharge orifice therein, and a connector sleeve having one end connected with the valve flange and the opposite end connected with the valve head adjacent a marginal edge thereof. The connector sleeve has a resiliently flexible construction, such that when pressure within the container raises above a predetermined amount, the valve head shifts outwardly in a manner which causes the connector sleeve to double over and extend rollingly. DE10122557A1 relates to a device on the removal hole which prevents the product dripping out after wall pressure by hands is released. The device contains slit segments in one plane and as many slit segments in a second plane, respective plane segments being positioned so the bottom edges of the first segments make contact with the top edges of the second segments in each case. Two or four segments are preferred and the container seal is by screw or snap action. Container lid and seal are hinged together and preferred segment thickness is 0.25 mm, the device diameter being 10-20 mm CN2784322Y relates to a headstand bottle, which comprises a bottle body, a bottle cap and an outer packing cap, wherein the opening of bottle body is opened downwards; the bottle cap is fixedly connected to the lower end of the bottle body through a screw and is provided with a liquid outlet; a silica gel inner cap and an inner partition board are orderly fixed to the position between the opening of the bottle cap and the opening of the bottle body. Because the utility model has the opening opened downwards of the bottle body and adopts the silica gel inner cap and the partition board, liquid in the liquid bottle which is reversely arranged cannot flow out naturally. The utility model has the advantages of simple structure, convenient use and opening, sanitation and cleanness, application for bottles filled with little liquid, natural, convenient, and clean pouring of the liquid, and special application for loading various viscous liquid, such as liquid shampoo, cleanser essence, etc. CN1507827A relates to a wall liquid soap distributor for washroom. Said distributor adopts a bottle with a certain elasticity, said bottle can be inverted for use, its liquid outlet is smaller than mouth of general bottle, on the bottle mouth position a platform surface is formed, on the platform surface an elastic thin sheet is placed, and on the elastic thin sheet several opening and closing seams are set, a bottle cap whose inner wall has screw and whose center has a circular hole can be tightly screw-turned on the bottle body and can be used for tightly pressing the opening and closing seams. Said invention is simple in structure, low in cost, and also provides its application method. US 2008/029548 A1 relates to dispensing packages for fabric treatment compositions, such as bottom dispensing packages for flowable compositions. US 2016/244222 A1 relates to a dispensing system that includes a bottle, a valve cap, a dosing cap, the bottle includes a side wall having at least a portion that is flexible, the valve cap regulates the dispensing of a flowable product from bottle into the dosing cap.

EP3492400A (application number 17204557) relates to a liquid dispenser for dispensing liquid from an inverted container. The dispenser comprises a body, a valve and an impact resistance system especially adapted for absorbing transient liquid pressure increases (e.g., hydraulic hammer pressure) to substantially reduce/prevent undesirable opening of the valve and leakage of the liquid.

SUMMARY OF THE INVENTION

The present invention relates to a bottom dispensing package (1) for a liquid comprising: a resiliently squeezable container (10) for housing a fluid, the resiliently squeezable container comprising a wall (21); a base (20) operably connected to said container (10), wherein the base (20) comprises an orifice (30), wherein the orifice (30) comprises a slit-valve (40); characterized in that the resiliently squeezable container (10) has an elasticity index of greater than 0.65% to 2.0%, as measured using the elasticity index method described herein.

DETAILED DESCRIPTION OF THE INVENTION

Figure 1:
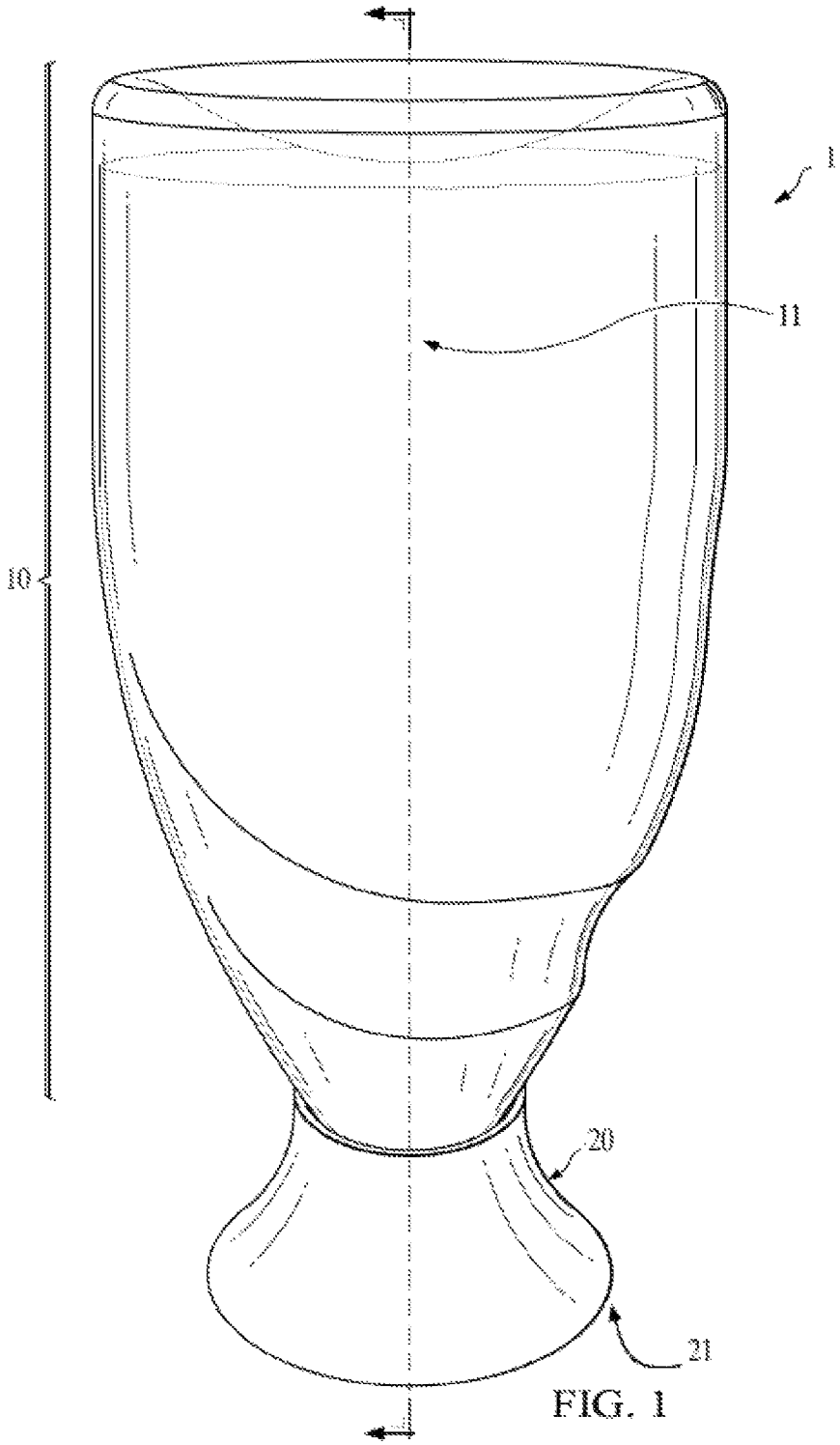
FIG. 1 is a front view of a bottom-dispensing package (1) according to one embodiment of the present invention. The package (1) comprises a resiliently squeezable container (10) and a base (20). The resiliently squeezable container (10) comprises at least one wall (11). The base (20) comprises a bottom surface (21) adapted for resting the package (1) on a flat surface in the upside down position.
Figure 2:
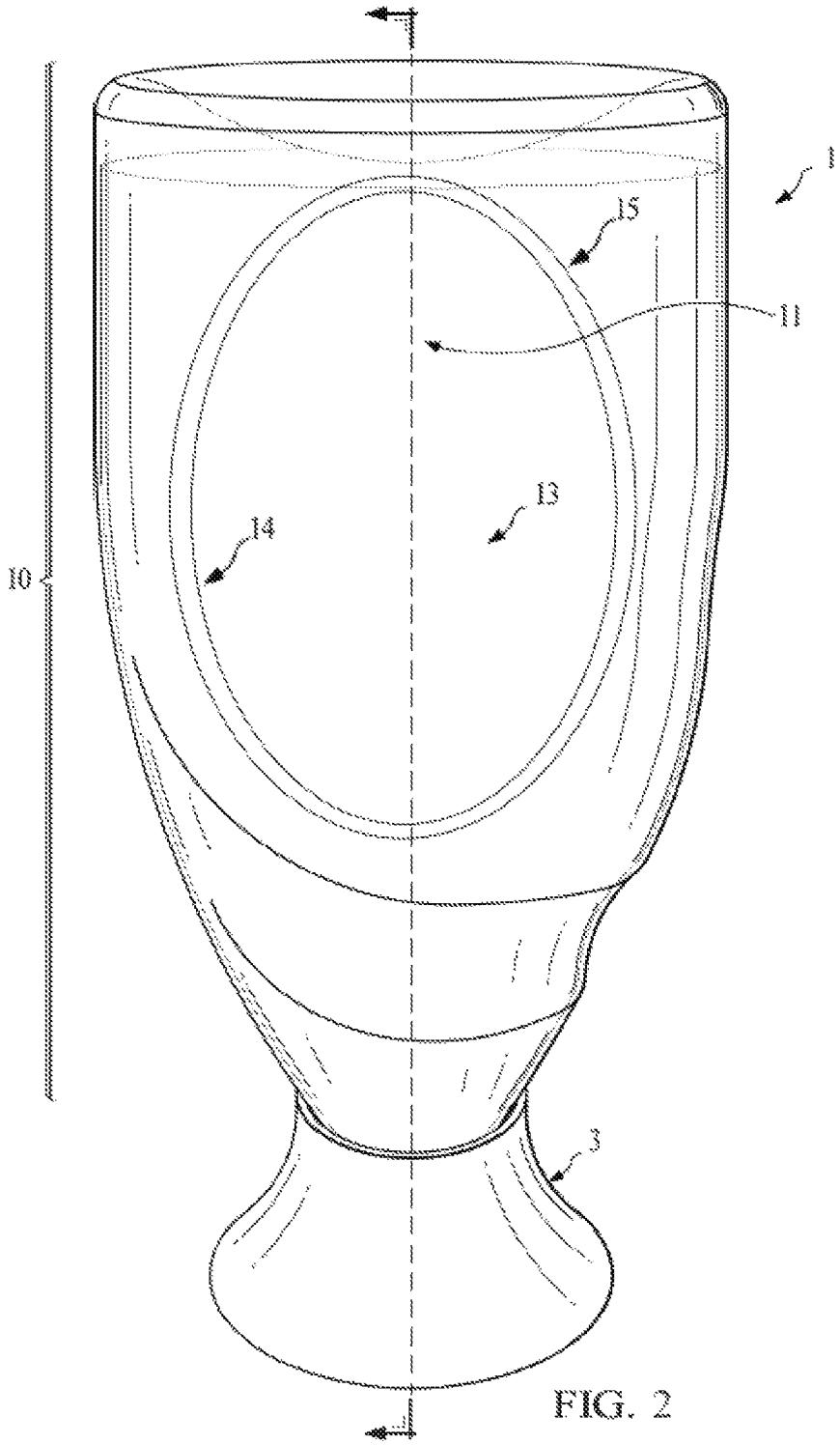
FIG. 2 is a front view of a bottom-dispensing package (1) according to one embodiment of the present invention. The wall (11) of the resiliently squeezable container (10) comprises a flexible panel (13) on the front which also forms the panel for attaching a printed label, and a panel circumference (14). The panel-circumference (14) comprises a flexible hinge element (15) such that the panel (13) is able to move more freely relative to the rest of the wall (11).
Figure 3:
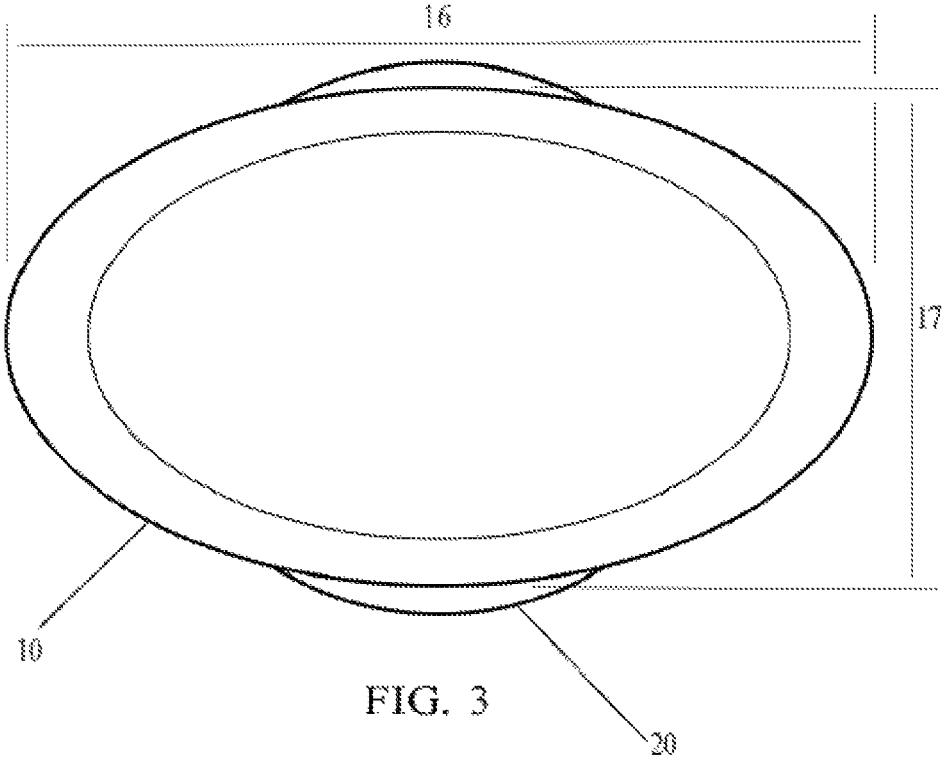
FIG. 3 is a top view of the bottom-dispensing package (1) of FIG. 1, showing the maximum cross-sectional width (16) and the maximum cross-sectional depth (17).
Figure 4:
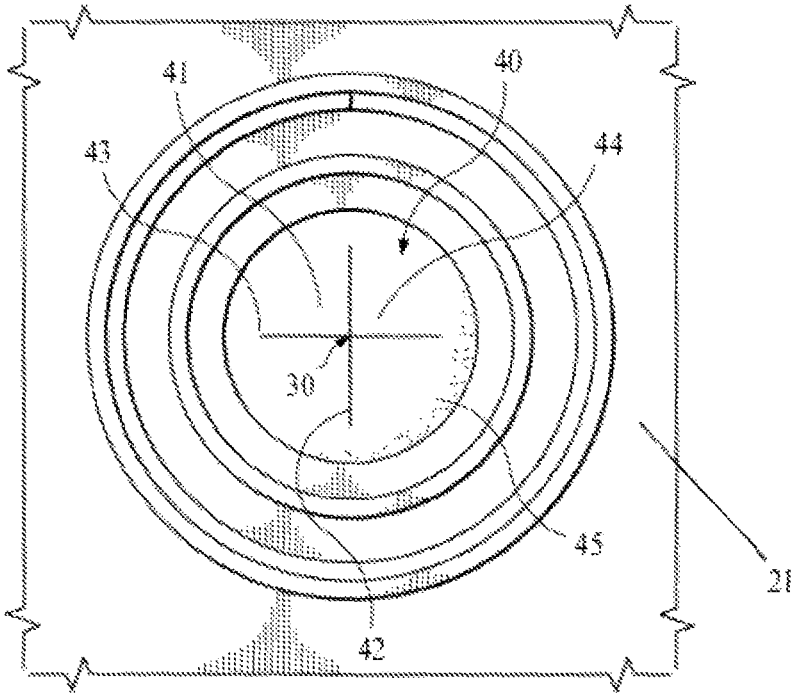
FIG. 4 is a view of the orifice (30) from the interior side (45). The orifice (30) comprises a slit-valve (40), the slit-valve (40) comprises a flexible central portion (41) having slits (42) therein. The slits (42) extend radially outward towards distal ends (43). The slits form a star pattern defining flaps (44).
Figure 5:
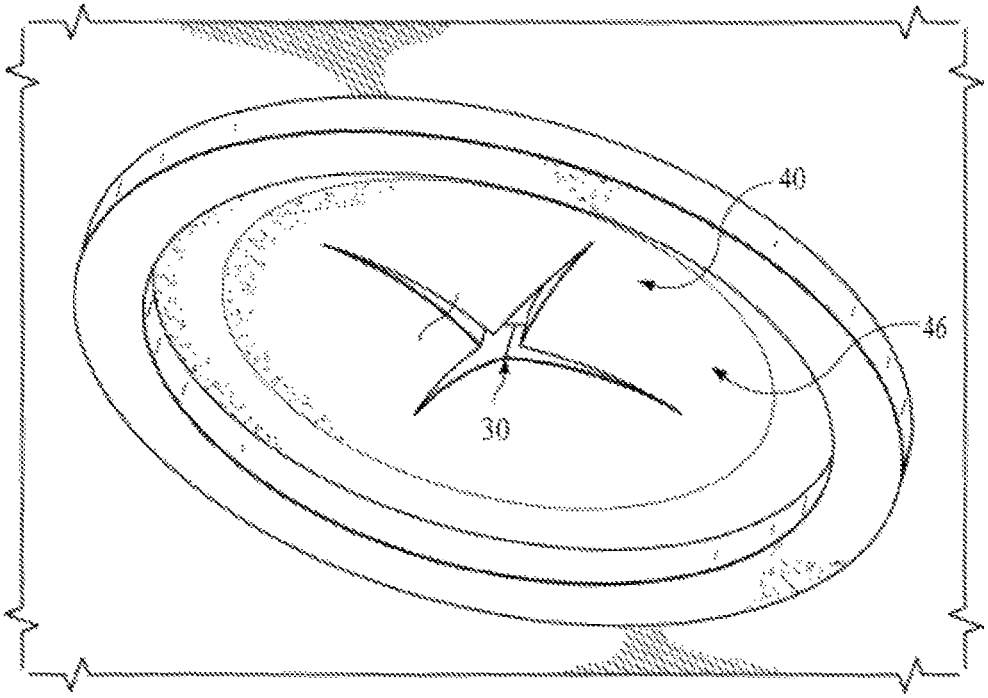
FIG. 5 is a view of the bottom surface (21) of the base (20) of the package (1) of FIG. 1, showing the orifice (30) and slit valve (40), viewed from the exterior side (46).
Figure 6:
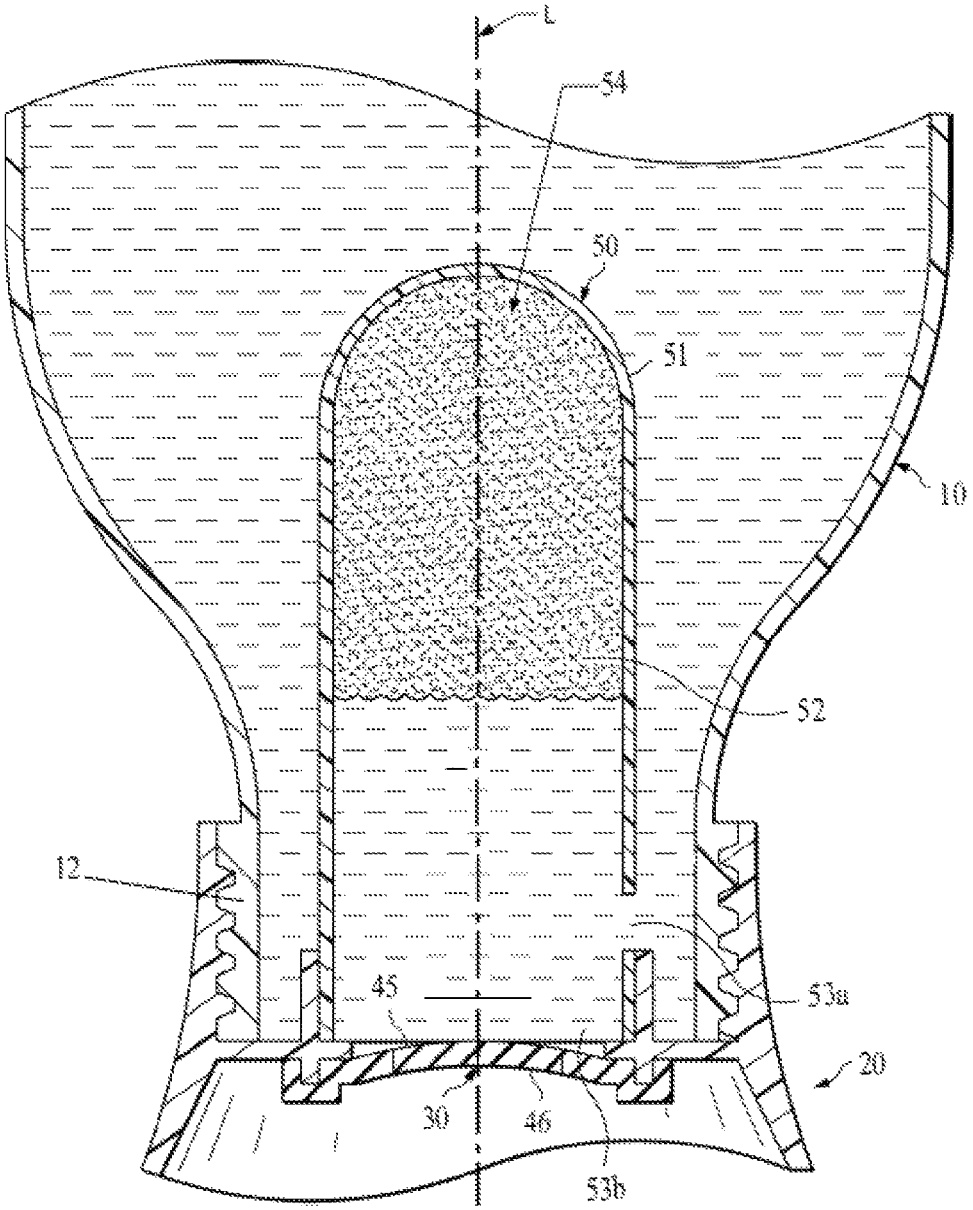
FIG. 6 is a partial cut away view of an embodiment of the present package (1), which further comprises an impact resistance system (50) localized upstream of the orifice (30). The system (50) comprises a housing (51) having a cavity (52) therein and extending longitudinally and radially inwardly from the base (20), wherein the housing (51) comprises at least one inlet opening (53*a*) that provides a flow path for the liquid from the resiliently squeezable container (10) into the housing (51) and at least one outlet opening (53*b*) that provides a path of egress for the liquid from the housing (51) to the exterior atmosphere when the orifice (30) is opened, wherein the cavity (52) is adapted to be partially occupied by a compressible substance (54).
Figure 7:
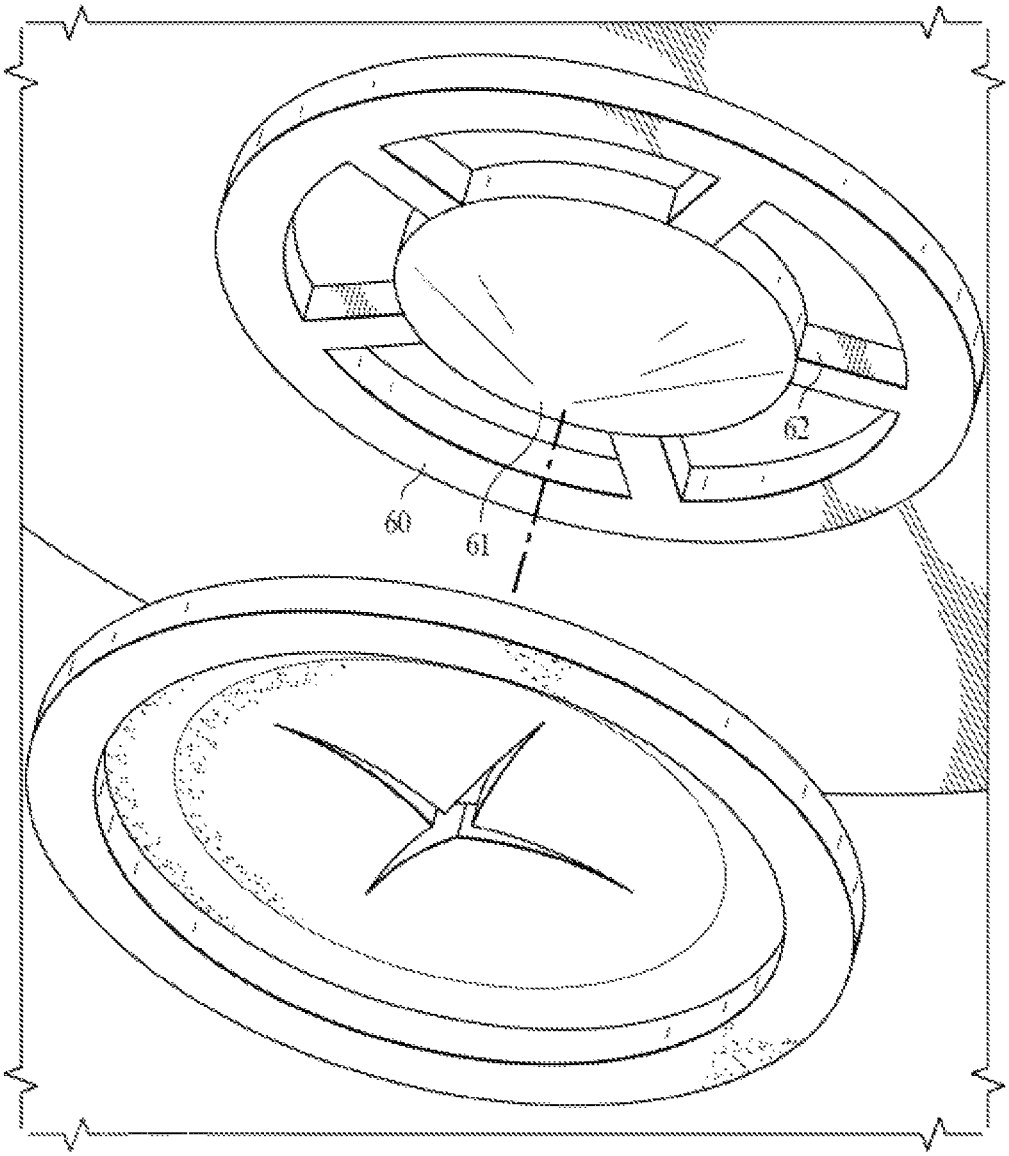
FIG. 7 is a perspective view of the package (1) of FIG. 6, further comprising a baffle (60) located in between the interior side (45) of the orifice (30) and the impact resistance system (50). The baffle (60) includes an occlusion member (61) supported by at least one support member (62).

It has surprisingly been discovered that a cause of product leakage, especially for lower viscosity product, is temperature variation during transport, or during storage. For example, for liquid dishwashing products, the package (1) is often stored on the window-ledge, next to the sink. As the temperature increases, the liquid contained within the resiliently squeezable container (10) expands, resulting in liquid being pushed out of the slit-valve (40). The effect is more pronounced as more of the liquid has been dispensed, since the dispensed liquid is replaced by air in the resiliently squeezable container (10), which has a greater coefficient of expansion upon temperature increases than the product it has replaced.

By resiliently squeezable, what is meant is that the wall exhibits a degree of flexibility sufficient to permit deformation in response to manual forces applied to the outer surface of the wall (11) and a degree of resilience sufficient to return automatically to its undeformed condition when said manually applied forces are removed from the outer surface of the wall (11).

By the terms "a" and "an" when describing a particular element, we herein mean "at least one" of that particular element.

The term "dose" as used herein is defined as the measured amount of liquid to be delivered by the package. The dose begins when the liquid first exits the cap orifice (30) and ends once the flow of said liquid stops.

By "substantially independently from pressure" as used herein it is meant that pressure causes less than 10% variation from the target measured dose.

By "substantially constant liquid output or dosage" as used herein it is meant that variation from the target measured dose is less than 10%.

By "shear thinning" as used herein it is meant that the liquid referred to is non-Newtonian and preferably has a viscosity that changes with changes in shear rate.

By "drip-free" as used herein it is meant that no visible residue is left proximal to the nozzle of the cap following dosing and/or that no liquid exits the resilient container without squeezing.

The invention is directed to a package (1) for repeatedly dosing a quantity of liquid. The package (1) comprises a resiliently squeezable container (10), and a base (20) operably connected to said container (10). The base comprises an orifice (30), wherein the orifice (30) comprises a slit-valve (40).

A preferred field of use is that of dosage devices for domestic or household use, containing detergents such as hard surface cleaning compositions, liquid laundry detergent compositions, or other cleaning preparations, fabric conditioners and the like, typically having relatively low low-shear viscosities. A particularly preferred field of use is hard surface cleaning, especially manual dishwashing. For such applications, the resiliently squeezable container (10) can have an overflow volume, as measured using the method described herein, of from 0.1 litres to 5 litres, preferably from 0.2 litres to 1.5 litres, more preferably from 0.25 litres to 0.75 litres. The volume of liquid dosed for each squeeze of the package (1) is typically from 1 ml to 50 ml, preferably from 2 ml to 30 ml, more preferably 3 ml to 20 ml.

The package comprises a resiliently squeezable container (10), preferably a bottle. The resiliently squeezable container (10) comprises at least one wall (11). Typically, such containers for bottom-dispensing applications are designed to be as stiff as possible, in order to maintain their form after use. When the container is too elastic, the container does not readily return to its original form after being squeezed during use. However, it has been surprisingly discovered that if the container is too stiff, the leakage during storage is greater, especially for lower viscosity and/or non-thixotropic liquids. This leakage is getting more pronounced as the internal liquid volume decreases throughout the lifetime of the product and/or the liquid product is exposed to temperature increases such as when exposed to sunlight such as when being stored on a window shelf. As such, the resiliently squeezable container (10) has an elasticity index of from 0.75% to 1.75%, preferably from 0.85% to 1.4%, as measured using the elasticity index method described herein.

The resiliently squeezable container (10) is made using injection stretch blow-moulding (ISBM) processes.

In extrusion blow-moulding, the molten resin is extruded (typically continuously) to form an open-ended continuous tube (a "parison"). The extruded resin is cut at regular intervals and the cuts are directly blow-moulded to form an article. In the extrusion blow-moulding process, the molten resin material is typically not first formed into a preform. The final shape of an article produced by extrusion blow-moulding is less precise and less controllable than those obtained by injection blow-moulding. Further details on extrusion blow-moulding can be obtained in general packaging textbook, for example in "The Wiley Encyclopaedia of Packaging Technology", referred to above (in particular pages 83-86). Extrusion blow-moulding may be used to obtain laminated or co-extruded containers with multiple layers for aesthetic or improved physical (barrier) properties.

Injection blow-moulding (IBM) and its variant, injection stretch blow-moulding (ISBM), are commonly used to manufacture high quality hollow articles, such as containers, on an industrial scale. The resiliently squeezable container (10) is made by blow-moulding a preform, for instance, using an injection-stretch blow-moulding process. In contrast to injection blow moulded containers, injection stretch blow moulded containers typically have thinner walls, and greater elasticity.

In the first step of both IBM and ISBM processes, a preform is made, typically by an injection-moulding process, as described earlier. Such preforms are typically test-tube shaped, having a fully formed neck (12) by which the preform is handled during processing. The wall thickness of the preform can be varied in order to affect the distribution of resin material in the resiliently squeezable container (10).

The neck (12) typically comprises an attachment means for attaching the base (20), such as a screw thread or bayonet mount, as is known in the art, with the base (20) comprising the corresponding part of the attachment means.

The preform is subsequently blow-moulded or stretch blow-moulded to form the resiliently squeezable container (10). As mentioned earlier, the neck of the preform typically remains substantially unchanged during the blow-moulding process while the body of the preform will expand considerably. The preform can be blow moulded, or stretch blow moulded, immediately after forming. Alternatively, the preform can be stored, or transported to a different location, before later being reheated and blown into the final container.

In the injection "blow-moulding process", the preform is reheated, if necessary, before being transferred to a blow-mould having the shape of the desired hollow container. The preform is held by the neck (12) and air passing through a valve inflates the hot preform, which is typically at a temperature of from 85° C. to 115° C. The preform expands and takes the form of the blow-mould. Typically, little or no axial stretching takes place. After the desired container has sufficiently cooled to be handled, it is removed from the blow-mould and is ready for use. More information on injection blow-moulding processes can be obtained from general textbooks, for example "The Wiley Encyclopaedia of Packaging Technology", Second Edition (1997), published by Wiley-Interscience Publication (in particular see page 87).

In the injection "stretch blow moulding" process (sometimes referred to as biaxial-orientation blow-moulding), the preform is reheated to a temperature warm enough to allow the preform to be inflated so that a biaxial molecular alignment in the sidewall of the resulting blow-moulded container is achieved. With the preform held at the neck (12), air pressure, and usually a stretch rod, are used to stretch the preform in the axial direction, and optionally also in the radial direction. Unlike containers obtained by conventional injection blow-moulding, the containers obtained by injection stretch blow-moulding are significantly longer than the preform (1). More information on injection stretch blow-moulding processes can be obtained from general textbooks, for example "The Wiley Encyclopaedia of Packaging Technology", Second Edition (1997), published by Wiley-Interscience Publication (in particular see pages 87-89).

The desired elasticity of the resiliently squeezable container (10) can be achieved using any suitable means, including through the selection of the resin material used for forming the container (10), limiting the wall thickness through using less resin material to make the container (10), and by including at least one flexible panel (13) in the resiliently squeezable container (10), or by having a non-circular cross-section, or a combination thereof.

Resin materials suitable for use in making the resiliently squeezable container (10) can be selected from the group consisting of: polyethylene terephthalate (PET), polypropylene (PP), and mixtures thereof, preferably polyethylene terephthalate (PET). Such materials are particularly suitable when forming the container (10) using an injection stretch blow-moulding process. The combination of such resins, and especially polyethylene terephthalate (PET), with forming the container (10) using injection stretch blow moulding, results in containers (10) that have both good structural rigidity as well as elasticity. However, the improved elasticity typically results in poor spring back after compression of the container (10). This is particularly important for bottom-dispensing packages, as the spring-back of the container (10) provides the pressure differential to draw air through the slit-valve (40), so that the container (10) can return to its original shape after squeezing of the container (10).

Since a relatively high container elasticity is desired, the resiliently squeezable container (10) can comprise the resin material, such that the ratio of weight of the resin material (in grams) to the overflow volume (in millilitres) is less than 0.058:1, preferably from 0.035:1 to 0.057:1, more preferably from 0.040:1 to 0.054:1.

The container elasticity can also be improved through the addition of at least one flexible panel (13) to the wall (11), wherein the at least one flexible panel (13) forms at least 40%, preferably from 40% to 75%, more preferably from 50% to 65% of the outer-surface of the wall (11) and the panel (13) has an average thickness of from 0.1 mm to 0.7 mm, preferably from 0.2 mm to 0.5 mm, more preferably from 0.25 mm to 0.4 mm; or the panel (13) comprises a panel-circumference (14) surrounding the panel (13), the panel-circumference (14) comprising a flexible hinge element (15) such that the panel (13) is able to move relative to the rest of the wall with a change in internal pressure; and mixtures thereof. Preferably, at least 60%, or at least 75%, or at least 90%, or 100% of the panel-circumference (14) is surrounded by the flexible hinge element (15). Preferably, the panel (13) is coincident with the label area. Preferably, the wall (12) comprises a front flexible panel (13) and a back flexible panel (13). The panel thickness can be measured by any suitable means, for instance, using a Magnamike 8600 (supplied by Presto Group, using a ball diameter of 3.175 mm), using the instructions provided. Sufficient measurements across the surface of the panel should be made in order to ensure the average thickness is measured.

In order to increase the elasticity of the resiliently squeezable container (10), the resiliently squeezable container (10) can comprise a non-circular cross-section. In preferred such embodiments, the resiliently squeezable container (10) has a maximum ratio of the cross-sectional width (16) to the cross-sectional depth (17) which is greater than 1.25, preferably from 1.25 to 3.0, more preferably from 1.5 to 2.0, wherein the cross-sectional width and depth are measured at a selected height of the resiliently squeezable container. The cross-sectional width is the width of the container, with the front of the container facing the viewer. For example, when the front label panel is facing the viewer. The cross-sectional depth is the measured perpendicular to the cross-sectional width, measuring from the front of the container to the back, such as from the front label to the back label, if present.

The package comprises a base (20) operably connected to the container (10). The base comprises an orifice (30) which comprises a slit-valve (40).

The base (20) can comprise a bottom surface (21) adapted for resting the package (1) on a flat surface.

The orifice (30) is comprised on the base (20). The package can comprise a cap (22, not shown) which is at least partially detachable, more preferably fully removable. Since the package is more resistant to leakage due to changes in pressure during transport and storage, the cap is preferably not sealingly engaged to the orifice (30). Preferably, the base (20) does not comprise a cap (22) or comprises a cap (20) which is fully detachable and can be removed and discarded prior to first use. Alternatively the base (20) can also comprise a sticker covering the orifice (30) as additional protection against leakage during transport.

The slit-valve (40) is preferably a flexible, elastomeric, resilient, 2-way bi-directional, self-closing, slit-type valve mounted within the orifice (30). The slit-valve (40) comprises a flexible central portion (41) having a slit or slits (42) therein. The slits (42) typically extend radially outward towards distal ends (43). For example, the orifice (30) may comprise a slit-valve (40) formed from one slit (42) or two or more intersecting slits (42), that may open to permit dispensing of liquid through the orifice (30) in response to an increased pressure inside the resiliently squeezable container (10), such as when the resiliently squeezable container (10) is squeezed. The slit-valve (40) preferably comprises at least two coincident slits (42), preferably wherein the slits form a star pattern, defining flaps (44). More preferably, the slit-valve comprises two coincidental slits (42) to balance ease of dosing and prevention of leakage.

The slit-valve (40) is typically designed to close the orifice (30) and stop the flow of liquid through the orifice (30) upon a reduction of the pressure differential across the slit-valve (40). The amount of pressure needed to open the slit-valve (40) will partially depend on the internal resistance force of the slit-valve (40). The "internal resistance force" (i.e., cracking-pressure) refers to a pre-determined resistance threshold to deformation/opening of the slit-valve (40). In other words, the slit-valve (40) will not tend to resist deformation/opening so that it remains closed under pressure of the steady state liquid bearing against the interior side (45) of the orifice (30). The amount of pressure needed to deform/open the valve must overcome this internal resistance force. This internal resistance force should not be so low as to cause liquid leakage. Accordingly, the slit-valve (40) preferably has an opening pressure differential from the interior side (45) to the exterior side (46) of the orifice (30) of at least 10 mbar, preferably at least 15 mbar, more preferably at least 25 mbar, measured at 20° C. The internal resistance force should not be so high as to make dispensing a dose of liquid difficult. Accordingly, the slit-valve (40) preferably has an opening pressure differential from the interior side (45) to the exterior side (46) of the orifice (30) of less than 250 mbar, even more preferably less than 150 mbar, most preferably less than 75 mbar, measured at 20° C.

Especially where the bottom-dispensing package (1) comprises a low viscosity liquid, the use of a slit valve (40) which opens at a relatively low-pressure differential helps to avoid spurting of the composition out of the orifice (30). As such, especially where the bottom dispensing package (1) comprises a liquid detergent composition having viscosity of from 100 mPa·s to 3,000 mPa·s, preferably from 300 mPa·s to 2,000 mPa·s, most preferably from 500 mPa·s to 1,500 mPa·s, measured at a shear rate of 10 $s^{-1}$, the slit valve (40) preferably opens at a pressure differential of from 10 to 250 mbar, preferably from 15 to 150 mbar, more preferably from 25 to 75 mbar, measured at 20° C.

Moreover, the use of a slit-valve (40) which opens at such low-pressure differentials also means that a smaller pressure differential is required to draw air through the slit-valve (40) once the squeezing has been removed, so that the container (10) can return to its original shape. This is particularly important for packages (1) which comprise a more elastic container (10) since an insufficient pressure differential across the slit-valve (40) means that not enough air is drawn through the valve (40) and into the container (10) for the container to revert back to its undeformed shape.

The opening pressure differential (in mbar) is typically measured using a water column, to which the slit-valve has been sealingly attached to the bottom of the water-column, then measuring the water-height required to open the slit valve, at the target temperature.

Preferably the slit-valve (40) has a surface area of between 0.1 $cm^2$ and 10 $cm^2$, more preferably between 0.3 $cm^2$ and 5 $cm^2$, most preferably between 0.5 $cm^2$ and 2 $cm^2$. Preferably the slit-valve (40) has a height of between 1 mm and 10 mm, more preferably between 2 mm and 5 mm Other dimensions could be used so long as they allow for the slit-valve (40) to remain in the fully closed position at rest.

The slit-valve (40) can be made from a thermoplastic elastomer, silicone, and mixtures thereof, preferably from silicone, and may comprise additives known in the art, such as for optimizing the valve durability and flexibility.

The bottom dispensing package (1) of the present invention is less prone to leakage due to pressure changes during storage and transport, for instance, from variations in temperature. However, leakage can also be due to transient liquid pressure increases from impact, such as if the package is dropped or placed on a surface with sufficient force. Such transient liquid pressure increases, also referred to as hydraulic hammer pressure, inside the container can momentarily force open the valve causing liquid to leak out.

As such, the base (20) of the bottom dispensing package (1) can further comprise: an impact resistance system (50) localized upstream of the orifice (30), the system (50) comprises a housing (51) having a cavity (52) therein and extending longitudinally and radially inwardly from the base (20), wherein the housing (51) comprises at least one inlet opening (53*a*) that provides a flow path for the liquid from the resiliently squeezable container (10) into the housing (51) and at least one outlet opening (53*b*) that provides a path of egress for the liquid from the housing (51) to the exterior atmosphere when the orifice (30) is opened, wherein the cavity (52) is adapted to be partially occupied by a compressible substance (54).

A suitable compressible substance (54) can be selected from a gas, a foam, a sponge or a balloon, preferably a gas, more preferably air. The ratio of the volume of the gas, preferably air, inside the housing (51) at a steady-state to the volume of the resiliently squeezable container (10) can be higher than 0.001, preferably between 0.005 and 0.05, more preferably between 0.01 and 0.02.

The housing (51) can have an internal volume of from 200 mm3 to 250,000 mm3, preferably from 1,500 mm3 to 75,000 mm3 The inlet opening (53*a*) can have a total surface area of 1 mm2 to 250 mm2, preferably 15 mm2 to 150 mm2 The housing (51) typically comprises, or is made from, a plastic material, preferably a thermoplastic material, preferably polypropylene.

The bottom dispensing package (1) can further comprise a baffle (60) located in between the interior side (45) of the orifice (30) and the impact resistance system (50), preferably the baffle (60) includes an occlusion member (61) supported by at least one support member (62) which accommodates movement of the occlusion member (61) between a closed position occluding liquid flow when the baffle (60) is subjected to an upstream hydraulic hammer pressure.

The bottom dispensing container (1) can be used as a dosage device for domestic or household use, containing detergents such as hard surface cleaning compositions, liquid laundry detergent compositions, or other cleaning preparations, fabric conditioners and the like. Other fields of use include dosage devices for manual and automatic dishwashing liquids, hair-care products and oral care applications such as mouth washes, beverages (such as syrups, shots of liquors, alcohols, liquid coffee concentrates and the like), food applications (such as food pastes and liquid food ingredients), pesticides, and the like. Preferably, the bottom dispensing container (1) comprises a hard surface cleaning composition, more preferably a hand dishwashing composition.

Since the bottom dispensing container (1) is less prone to leakage, the bottom dispensing container (1) is particularly suited for containing liquid compositions, especially liquid detergent compositions, having a viscosity of from 100 mPa·s to 3,000 mPa·s, preferably from 300 mPa·s to 2,000 mPa·s, most preferably from 500 mPa·s to 1,500 mPa·s, measured at a shear rate of 10 $s^{-1}$ following the viscosity test method described herein. The composition can be Newtonian or non-Newtonian, preferably Newtonian.

Preferably, the composition has a density between 0.5 g/mL and 2 g/mL, more preferably between 0.8 g/mL and 1.5 g/mL, most preferably between 1 g/mL and 1.2 g/mL.

The detergent composition, especially when formulated as a hand dishwashing composition, can comprises from 5% to 50%, preferably from 8% to 45%, most preferably from 15% to 40%, by weight of the total composition of a surfactant system.

For hand dishwashing applications, the surfactant system preferably comprises an alkyl sulfate anionic surfactant and a co-surfactant. The co-surfactant can be selected from the group consisting of an amphoteric surfactant, a zwitterionic surfactant and mixtures thereof. The surfactant system can comprise the anionic surfactant and co-surfactant in a weight ratio of from 8:1 to 1:1, preferably 4:1 to 2:1, more preferably from 3.5:1 to 2.5:1. The surfactant system can comprise from 60% to 90%, preferably from 65% to 85%, more preferably from 70% to 80% by weight of the surfactant system of alkyl sulfate anionic surfactant selected form the group consisting of: alkyl sulfate, alkyl alkoxy sulfate, and mixtures thereof. Preferred alkyl alkoxy sulfates are alkyl ethoxy sulfates. More preferred anionic surfactants are an alkyl ethoxy sulfate or a mixed alkyl sulfate-alkyl ethoxy sulfate anionic surfactant system, with a mol average ethoxylation degree of less than 5, preferably less than 3, more preferably less than 2 and more than 0.5. The mol average ethoxylation degree is calculated as the mole average degree of ethoxylation for the alkyl ethoxy sulfate blend or, if alkyl sulfate is present, for the mixed alkyl sulfate-alkyl ethoxy sulfate anionic surfactant system.

Preferably the alkyl ethoxy sulfate, or mixed alkyl sulfate-alkyl ethoxy sulfate, anionic surfactant has a weight average level of branching of from 5% to 60%, preferably from 10% to 50%, more preferably from 20% to 40%. The weight average branching degree is calculated as the weight average degree of branching for the alkyl ethoxy sulfate blend or, if alkyl sulfate is present, for the mixed alkyl sulfate-alkyl ethoxy sulfate anionic surfactant system.

Suitable examples of commercially available alkyl sulfate anionic surfactants include, those derived from alcohols sold under the Neodol® brand-name by Shell, or the Lial®, Isalchem®, and Safol® brand-names by Sasol, or some of the natural alcohols produced by The Procter & Gamble Chemicals company.

The surfactant system may comprise further anionic surfactant, including sulfonate such as HLAS, or sulfosuccinate anionic surfactants. However, the composition preferably comprises less than 30%, preferably less than 15%, more preferably less than 10% by weight of the surfactant system of further anionic surfactant. Most preferably, the surfactant system comprises no further anionic surfactant, other than the alkyl sulfate anionic surfactant.

The composition can further comprise a co-surfactant selected from the group consisting of an amphoteric surfactant, a zwitterionic surfactant and mixtures thereof, as part of the surfactant system. The composition preferably comprises from 0.1% to 20%, more preferably from 0.5% to 15% and especially from 2% to 10% by weight of the cleaning composition of the co-surfactant. The surfactant system of the cleaning composition of the present invention preferably comprises from 10% to 40%, preferably from 15% to 35%, more preferably from 20% to 30%, by weight of the surfactant system of a co-surfactant.

The co-surfactant is preferably an amphoteric surfactant, more preferably an amine oxide surfactant. Preferably, the amine oxide surfactant is selected from the group consisting of: alkyl dimethyl amine oxide, alkyl amido propyl dimethyl amine oxide, and mixtures thereof. Alkyl dimethyl amine oxides are preferred, such as C8-18 alkyl dimethyl amine oxides, or C10-16 alkyl dimethyl amine oxides (such as coco dimethyl amine oxide). Suitable alkyl dimethyl amine oxides include C10 alkyl dimethyl amine oxide surfactant, C10-12 alkyl dimethyl amine oxide surfactant, C12-C14 alkyl dimethyl amine oxide surfactant, and mixtures thereof. C12-C14 alkyl dimethyl amine oxide are particularly preferred.

Suitable zwitterionic surfactants include betaine surfactants. Such betaine surfactants includes alkyl betaines, alkylamidobetaine, amidazoliniumbetaine, sulfobetaine (INCI Sultaines) as well as the phosphobetaine. The most preferred zwitterionic surfactant is cocoamidopropylbetaine.

The surfactant system can further comprise from 1% to 25%, preferably from 1.25% to 20%, more preferably from 1.5% to 15%, most preferably from 1.5% to 5%, by weight of the surfactant system, of an alkoxylated non-ionic surfactant.

Preferably, the alkoxylated non-ionic surfactant is a linear or branched, primary or secondary alkyl alkoxylated non-ionic surfactant, preferably an alkyl ethoxylated non-ionic surfactant, preferably comprising on average from 9 to 15, preferably from 10 to 14 carbon atoms in its alkyl chain and on average from 5 to 12, preferably from 6 to 10, most preferably from 7 to 8, units of ethylene oxide per mole of alcohol.

Alternatively, or in addition, the compositions can comprise alkyl polyglucoside ("APG") surfactant, to improve sudsing beyond that of comparative nonionic surfactants such as alkyl ethoxylated surfactants. If present, the alkyl polyglucoside can be present in the surfactant system at a level of from 0.5% to 20%, preferably from 0.75% to 15%, more preferably from 1% to 10%, most preferably from 1% to 5% by weight of the surfactant composition.

The cleaning composition can have a pH of from 5 to 12, more preferably from 7.5 to 10, as measured at 10% dilution in distilled water at 20° C. The pH of the composition can be adjusted using pH modifying ingredients known in the art.

Suitable cleaning compositions are described in European Application EP 18151770.7.

Test Methods

Immersed Volume, Overflow Volume and Elasticity Index:

The test is done on containers which are at least 3 days old, in order to avoid the effects of container shrinkage after making. The test is done at a room temperature of 20° C. and a room atmospheric pressure of 1013+/−1 Pa.

Distilled water having a density of 1.000+/−0.002 g/ml, when measured at 20° C. is added to a beaker of volume at least 5 L. If desired, a dye may be added to improve visibility, so long at the target density is achieved.

The container is weighed using a laboratory balance having an accuracy of 0.001 g.

The container is then fully immersed in the beaker, with the opening facing up with the distilled water in the beaker at 20° C., expelling any remaining air in the container by gentle shaking. Holding the container by the stiffest part of the neck, the container is carefully lifted out of the beaker while avoiding squeezing of the container and spilling any of the solution. The filled container is wiped dry and re-weighed on the balance, in order to measure the weight of solution contained in the container when the container was immersed. From the weight of the distilled water, the immersed volume (ml) can be deduced. The container is then topped up to the brim with additional distilled water at 20° C. and the container reweighed, in order to measure the weight of the distilled water contained within the container after topping up to the brim. From this weight of surfactant solution, the overflow volume can be deduced. The overflow volume is the total volume of the distilled water contained in the container after topping up. The time between immersion in the basin and weighing must be less than 2 minutes.

The elasticity index is calculated using the following equation, expressed as a percent:

$$\text{Elasticity index} = \frac{\text{Overflow volume} - \text{Immersed volume}}{\text{Immersed volume}}$$

Peak Pressure

The peak pressure is the pressure within the empty container at a defined temperature above the fill temperature. A temperature and pressure probe (preferably MSR145B4 data logger) is placed within the empty container and the container is capped with a sealingly engaged cap (without an orifice), with the container maintained at a temperature of 20° C. and an atmospheric pressure of 1013+/−1 Pa, while ensuring that no additional pressure beyond the surrounding atmospheric pressure is exerted on the container during capping. The container is placed within a constant temperature oven, set at the desired temperature for 4 hours at 1013+/−1 Pa and the maximum (peak) pressure logged by the temperature and pressure probe is recorded. The method is repeated using 5 different containers and the average peak pressure is recorded.

Leakage

The containers are filled to 10% of the container size (recommended fill volume) at 20° C. with Fairy® original dark green dishwashing product having a viscosity in the range of 1,000+/−200 mPa·s, measured at a shear rate of 10 $s^{-1}$ (for example, Belgian market product, 2018), and the containers sealed with caps comprising V21-145 slit-valves (supplied by Aptar). Cups are weighed before the containers are placed upside down in the cups, with the container cap positioned a distance from the bottom of the cup. The containers are then placed, with the cups in a constant temperature oven kept at 40° C. The containers and cups are then removed from the oven after an hour, the container removed from the cup and the cup reweighed, in order to measure the weight of product that has leaked from the container.

Viscosity

The viscosity of the liquid detergent compositions is measured using a DHR-1 rotational rheometer from TA instrument, using a cone-plate geometry of 40 mm diameter, 2.008° angle with truncation gap of 56 μm. Unless otherwise mentioned, the viscosity is measured at a shear rate of 10 $s^{-1}$.

Examples

The elasticity index was measured for the following three containers, and the peak pressure measured at 40° C. (i.e. a delta of +20° C. above the fill temperature). As can be seen from the data below, containers having an elasticity index of above 0.65% result in a sharp reduction in the peak pressure as the temperature rises to 40° C. within the container. As a result, there is less internal pressure applied on the slit valve when the container is fitted with a slit-valve and oriented upside-down, resulting in a decreased leakage.

| Container | Container size * ml | Overflow volume ml | Immersed volume ml | Elasticity index | Peak pressure over 1 bar (1013.2 Pa) at 40° C. | Leaked amount g |
|---|---|---|---|---|---|---|
| Fairy Platinum Washing Up Liquid (UK, 2018) | 450 ml | 506.6 | 500 | 1.32% | 40.1 | 0.97 |
| Fairy Original Washing Up Liquid (UK, 2018) | 500 ml | 598.1 | 591 | 1.21% | 44.8 | 3.10 |
| Heinz 57 ketchup bottle (Be, 2018) | 500 ml | 552.1 | 550 | 0.18% | 77.3 | 24.75 |

* = recommended fill volume

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A bottom dispensing package (1) for a liquid composition comprising:

a. a resiliently squeezable container (10) for housing a fluid, the resiliently squeezable container comprising a wall (11) and a base (20) operably connected to said container (10), wherein the base comprises an orifice (30), wherein the orifice (30) comprises a slit-valve (40);

wherein the resiliently squeezable container (10) is an injection stretch-blow moulded container (ISBM), wherein the resiliently squeezable container (10) has an elasticity index $$\left(\frac{\text{Overflow volume} - \text{Immersed volume}}{\text{Immersed volume}} \times 100\right)$$

of greater than about 0.65% to about 2.0%, wherein the resiliently squeezable container (10) comprises a resin material, such that the ratio of weight of the resin material (in grams) to an overflow volume (in millilitres) is less than about 0.058:1, wherein the resiliently squeezable container (10) comprises:

i. a non-circular cross-section wherein the non-circular cross-section of the resiliently squeezable container (10) has a maximum ratio of a cross-sectional width (16) to a cross-sectional depth (17) which is greater than about 1.25, wherein the cross-sectional width and depth are measured at a selected height of the resiliently squeezable container (10);

ii. at least one panel (13) wherein the at least one panel (13) forms at least about 40% of an outer-surface (12) of the wall (11).

2. The bottom dispensing package (1) according to claim 1, wherein the resiliently squeezable container (10) has an overflow volume of from about 0.1 litres to about 5 litres.

3. The bottom dispensing package (1) according to claim 2, wherein the resiliently squeezable container (10) has an overflow volume of from about 0.2 litres to about 1.5 litres.

4. The bottom dispensing package (1) according to claim 1, wherein the resiliently squeezable container (10) has an elasticity index of from about 0.75% to about 1.75%.

5. The bottom dispensing package (1) according to claim 4, wherein the resiliently squeezable container (10) has an elasticity index of from about 0.85% to about 1.4%.

6. The bottom dispensing package (1) according to claim 1, wherein the resiliently squeezable container (10) is made from a resin material selected from the group consisting of: polyethylene terephthalate (PET), polypropylene (PP), and mixtures thereof.

7. The bottom dispensing package (1) according to claim 6, wherein the resin material is polyethylene terephthalate (PET).

8. The bottom dispensing package (1) according to claim 1, wherein the ratio of weight of the resin material (in grams) to the overflow volume (in millilitres) is from about 0.035:1 to 0.057:1.

9. The bottom dispensing package (1) according to claim 1, wherein the non-circular cross-section of the resiliently squeezable container (10) has a maximum ratio of the cross-sectional width (16) to the cross-sectional depth (17) which is from about 1.25 to about 3.0.

10. The bottom dispensing package (1) according to claim 9, wherein the non- circular cross-section of the resiliently squeezable container (10) has a maximum ratio of the cross-sectional width (16) to the cross-sectional depth (17) which is from about 1.5 to about 2.0.

11. The bottom dispensing package (1) according to claim 1, wherein the slit valve (40) opens at a pressure differential of from about 10 to about 250 mbar, measured at 20° C.

12. The bottom dispensing package (1) according to claim 1, wherein the wall (11) of the resiliently squeezable container (10) comprises the at least one panel (13) wherein the at least one panel (13) forms from about 40% to about 75% of the outer-surface (12) of the wall (11) and:

a. the panel (13) has an average thickness of from about 0.1 mm to about 0.7 mm; or b. the panel (13) comprises a panel-circumference (14) surrounding the panel (13), the panel-circumference (14) comprising a flexible hinge element (15) such that the panel (13) is able to move relative to a rest of the wall (11) with a change in internal pressure.

13. The bottom dispensing package (1) according to claim 12, wherein the panel (13) has an average thickness of from about 0.25 mm to about 0.4 mm.

14. The bottom dispensing package (1) according to claim 1, wherein the slit-valve (33) comprises at least two coincident slits (34).

15. The bottom dispensing package (1) according to claim 1, wherein the base (20) further comprises an impact resistance system (50) localized upstream of the orifice (30), the system (50) comprises a housing (51) having a cavity (52) therein and extending longitudinally and radially inwardly from the base (20), wherein the housing (51) comprises at least one inlet opening (53*a*) that provides a flow path for the liquid from the resiliently squeezable container (10) into the housing (51) and at least one outlet opening (53*b*) that provides a path of egress for the liquid from the housing (51) to the exterior atmosphere when the orifice (30) is opened, wherein the cavity (52) is adapted to be partially occupied by a compressible substance (54).

16. The bottom dispensing package (1) according to claim 1, wherein the bottom dispensing package (1) comprises a liquid detergent composition, the liquid detergent composition having viscosity of from about 100 mPa·s to about 3,000 mPa·s, measured at a shear rate of about 10 $s^{-1}$.

17. The bottom dispensing package (1) according to claim 16, wherein the liquid detergent composition comprises from about 5% to about 50%, by weight of surfactant.

* * * * *